US012578117B2

(12) United States Patent
Douglas et al.

(10) Patent No.: US 12,578,117 B2
(45) Date of Patent: Mar. 17, 2026

(54) BUILDING HVAC SYSTEM WITH SAMPLE COLLECTION

(71) Applicant: Tyco Fire & Security GmbH, Neuhausen am Rheinfall (CH)

(72) Inventors: Jonathan D. Douglas, Mequon, WI (US); Kirk H. Drees, Cedarburg, WI (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 682 days.

(21) Appl. No.: 17/959,139

(22) Filed: Oct. 3, 2022

(65) Prior Publication Data

US 2023/0103453 A1 Apr. 6, 2023

Related U.S. Application Data

(60) Provisional application No. 63/391,639, filed on Jul. 22, 2022, provisional application No. 63/252,050, filed on Oct. 4, 2021.

(51) Int. Cl.
*F24F 13/22* (2006.01)
*F24F 7/06* (2006.01)
(Continued)

(52) U.S. Cl.
CPC ..... *F24F 13/222* (2013.01); *F24F 7/06* (2013.01); *F24F 11/0001* (2013.01); *F24F 13/02* (2013.01)

(58) Field of Classification Search
CPC .... F24F 7/06; F24F 3/044; F24F 3/001; F24F 11/0001; F24F 11/89; F24F 13/222; F24F 13/02; F24F 2003/0446
See application file for complete search history.

(56) References Cited

U.S. PATENT DOCUMENTS 11,513,486 B2 11/2022 Kupa et al.
2014/0352333 A1* 12/2014 Marioni ..... F04D 15/0218 417/44.1
(Continued)

FOREIGN PATENT DOCUMENTS

WO WO-2021/258116 A1 12/2021

OTHER PUBLICATIONS

Alvarado et al., "A Methodology to Monitor Airborne PM10 Dust Particles Using a Small Unmanned Aerial Vehicle," Sensors, 2017, vol. 17 (25 pages).

*Primary Examiner* — Allen R. B. Schult
(74) *Attorney, Agent, or Firm* — Foley & Lardner LLP

(57) ABSTRACT

An air handling unit of an HVAC system of a building including ducting through which airflow is controllably pushed by a supply fan of the HVAC system, at least one of a heating or cooling device within the ducting, an air handling unit controller configured to control operation of the at least one of the heating or cooling device within the ducting to generate condensation from air flowing through the air handling unit, and a collector tray placed within and/or integrated with the ducting below the at least one of the heating or cooling device and structured to collect the condensation, via gravity, for use in analysis of the condensation, wherein the at least one of the heating or cooling device, the air handling unit controller, and the collector tray are configured to collect the condensation including infectious disease particles from the air flowing through the air handling unit.

20 Claims, 7 Drawing Sheets

(51) Int. Cl.
*F24F 11/00* (2018.01)
*F24F 13/02* (2006.01)

(56) References Cited

U.S. PATENT DOCUMENTS

2015/0316907 A1 11/2015 Elbsat et al.
2015/0338114 A1* 11/2015 Bauer ..... F24F 11/64 454/338
2017/0081707 A1 3/2017 Dillon et al.
2018/0357365 A1 12/2018 Meadow et al.
2021/0010701 A1 1/2021 Nesler et al.
2021/0193309 A1 6/2021 Boisvert et al.
2021/0200169 A1 7/2021 Ploegert et al.
2021/0222231 A1 7/2021 Dillon et al.
2021/0313075 A1 10/2021 Mc Namara et al.
2021/0356153 A1 11/2021 Nesler et al.
2021/0364181 A1 11/2021 Risbeck et al.
2021/0390807 A1 12/2021 Chaurasia et al.
2021/0390812 A1 12/2021 Chaurasia et al.
2021/0391089 A1 12/2021 Eswara et al.
2021/0398659 A1 12/2021 Sharma et al.
2021/0398690 A1 12/2021 Gibson et al.
2021/0398691 A1 12/2021 Dhamija et al.
2022/0060856 A1 2/2022 Wellig et al.
2022/0203287 A1 6/2022 Wenger et al.
2022/0203288 A1 6/2022 Wenger et al.
2022/0205962 A1 6/2022 Vanderkoy
2022/0207215 A1 6/2022 Liu et al.
2022/0221184 A1 7/2022 Gupta et al.
2022/0228756 A1 7/2022 Gupta et al.
2022/0254483 A1 8/2022 Boisvert et al.
2022/0277851 A1 9/2022 Wellig
2022/0282886 A1 9/2022 Hriljac et al.
2022/0293261 A1 9/2022 Mcbrady et al.
2022/0305438 A1 9/2022 Wenger et al.
2022/0305881 A1 9/2022 Neu et al.

* cited by examiner

BUILDING HVAC SYSTEM WITH SAMPLE COLLECTION

CROSS-REFERENCE TO RELATED APPLICATIONS

This application claims priority to and the benefit of U.S. Provisional Application No. 63/252,050, filed Oct. 4, 2021, and U.S. Provisional Application No. 63/391,639, filed Jul. 22, 2022, each of which are incorporated herein by reference in their entireties.

BACKGROUND

The present disclosure relates generally to building systems. The present disclosure relates more particularly to the collection of particles from the air of a building. In building environments, the particles in the air can be captured and the particles can include pathogens.

SUMMARY

Some implementations relate to an air handling unit of an HVAC system of a building including ducting through which airflow is controllably pushed by a supply fan of the HVAC system, at least one of a heating or cooling device within the ducting, an air handling unit controller configured to control operation of the at least one of the heating or cooling device within the ducting to generate condensation from air flowing through the air handling unit, and a collector tray placed within and/or integrated with the ducting below the at least one of the heating or cooling device and structured to collect the condensation, via gravity, for use in analysis of the condensation, wherein the at least one of the heating or cooling device, the air handling unit controller, and the collector tray are configured to collect the condensation including infectious disease particles from the air flowing through the air handling unit.

In some implementations, the at least one of the heating or cooling device including a cooling coil and a heating coil configured to cool and heat, respectively, the air moved through the ducting by the supply fan, the air handling unit controller configured to selectively control operation of the cooling coil and the heating coil to generate the condensation.

In some implementations, the condensation is collected when the cooling device is in a cooling mode or when the heating device is in a heating mode.

In some implementations, the air handling unit further includes a return air damper coupled to the ducting and configured to intake return air, an outside air damper coupled to the ducting and configured to intake outside air, and an exhaust air damper coupled to the ducting and configured to dispel the return air.

In some implementations, the air handling unit controller is further configured to selectively control an airflow source of the air flowing through the air handling unit, and wherein the airflow source includes at least one of the return air or the outside air.

In some implementations, selectively controlling the airflow source includes controlling at least one of the return air damper or the outside air damper, and wherein the condensation is collected and used for analysis when the airflow source is the return air and the outside air damper is closed.

In some implementations, the air handling unit controller is further configured to selectively control the exhaust air damper to dispel the return air for a period of time based on collecting the condensation including the infectious disease particles.

In some implementations, the air handling unit is a rooftop air handling unit configured to be positioned on a roof of the building.

Some implementations relate to an air handling unit of an HVAC system including ducting through which airflow is controllably pushed by a supply fan of the HVAC system, a humidifier within the ducting and configured to evaporate water into air flowing through the ducting, wherein a portion of the water is not evaporated into the air, and a collector tray placed within and/or integrated with the ducting below the humidifier and structured to collect the portion of the water from the humidifier not evaporated into the air, via gravity, for use in analysis of the water, wherein the collector tray is configured to collect condensation including infectious disease particles from the air flowing through the air handling unit.

In some implementations, including an air handling unit controller configured to activate the humidifier when the air handling unit is in a heating mode of operation.

In some implementations, the air handling unit further includes a return air damper coupled to the ducting and configured to intake return air, an outside air damper coupled to the ducting and configured to intake outside air, and an exhaust air damper coupled to the ducting and configured to dispel the return air.

In some implementations, the air handling unit controller is further configured to selectively control an airflow source of the air flowing through the air handling unit, and wherein the airflow source includes at least one of the return air or the outside air.

In some implementations, selectively controlling the airflow source includes controlling at least one of the return air damper or the outside air damper, and wherein the condensation is collected and used for analysis when the airflow source is the return air and the outside air damper is closed.

In some implementations, the air handling unit controller is further configured to selectively control the exhaust air damper to dispel the return air for a period of time based on collecting the condensation including the infectious disease particles.

In some implementations, the air handling unit is a rooftop air handling unit configured to be positioned on a roof of a building.

In some implementations, the air handling unit further includes a reheat coil within the ducting, wherein the reheat coil heats or pressurizes the air in the ducting prior to the humidifier evaporating the water.

Some implementations relate to a method of collecting condensations, the method including receiving, by an air handling unit of an HVAC system, air controllably pushed from a supply fan of the HVAC system through ducting, generating, by the air handling unit using at least one of a heating device, cooling device, or humidifier within the ducting, condensation based on heating or cooling of the air, and collecting, by the air handling unit via gravity, the condensation for use in analysis of the condensation, wherein the condensation includes infectious disease particles from the air flowing through the air handling unit.

In some implementations, the at least one of a heating or cooling device include a cooling coil and a heating coil configured to cool and heat, respectively, the air moved through the ducting by the supply fan, and wherein the method further includes selectively controlling, by the air handling unit, operation of the cooling coil and the heating coil to generate the condensation.

In some implementations, the method further includes activating, by the air handling unit, the humidifier when the air handling unit is in a heating mode of operation.

In some implementations, the method further includes selectively controlling, by the air handling unit, an airflow source of the air flowing through the air handling unit, and wherein the airflow source includes at least one of a return air or an outside air, and wherein selectively controlling the airflow source includes controlling at least one of a return air damper or an outside air damper, and wherein the condensation is collected when the airflow source is the return air and the outside air damper is closed.

DETAILED DESCRIPTION

Overview

Referring generally to the FIGS., various example systems and methods are shown and described relating to utilizing cooling coils, heating coils, reheat coils, humidifiers, and/or samplers to extract and collect samples. According to various implementations, a building management system may include one or more components for extracting and collecting samples from air. The samples can be in liquid form based on cooling or heating the air received from returned air and/or outdoor air. For example, the water in the air can be condensed on the surface of the cooling coil, making the entire surface of the cooling coil wet. Over time this water flows down the surface (based on gravitational force) of the cooling coil and is collected by a collection apparatus. In some embodiments, the collection apparatus collector tray can collect the condensation including infectious disease particles from the air flowing through the air handling unit. In various embodiments, the condensation can be collected and used for analysis when the system is in a particular mode (e.g., cooling mode, heating mode, sampling mode).

Figure 1:
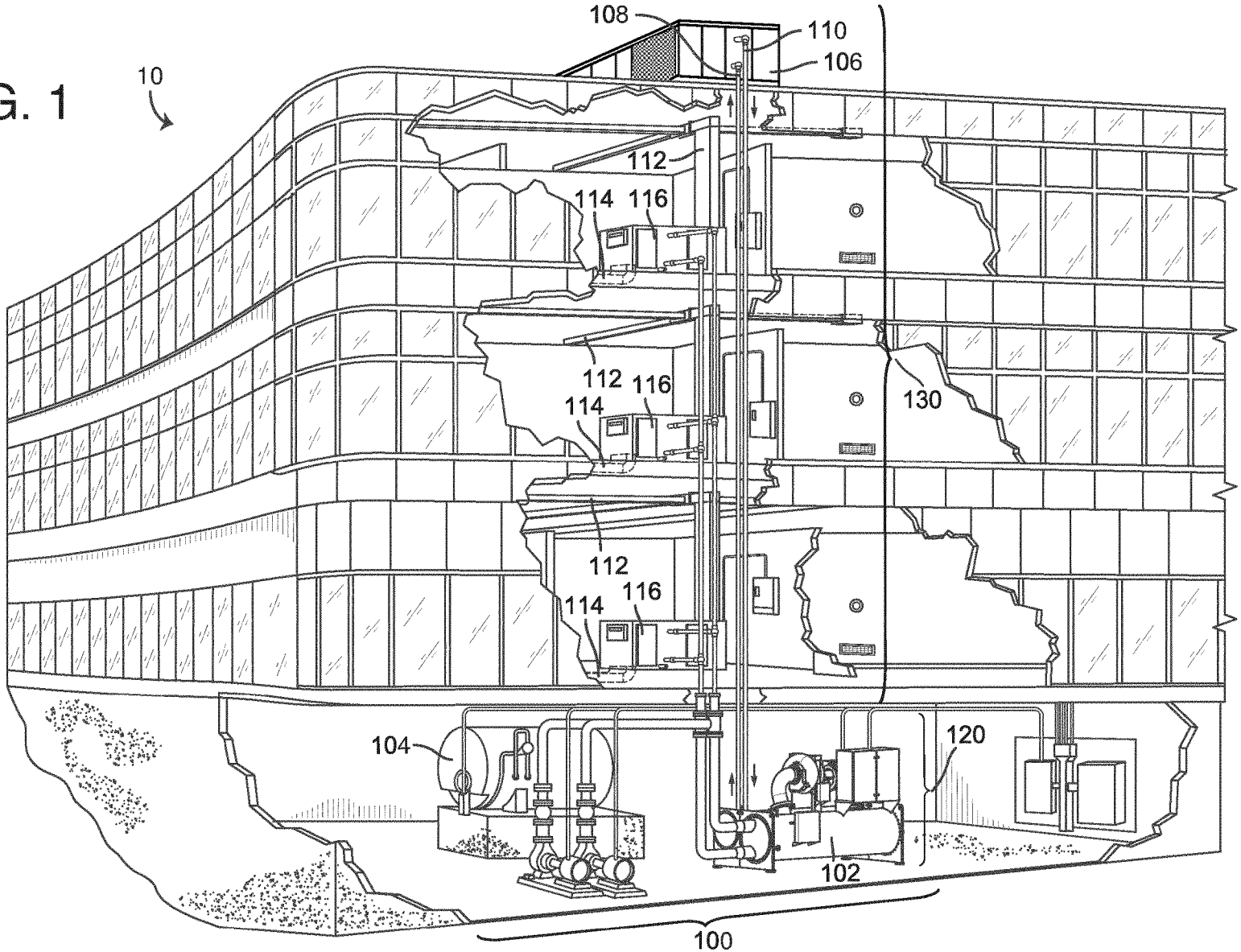
FIG. 1 is a drawing of a building equipped with a HVAC system, according to some embodiments.

Referring now to FIG. 1, a perspective view of a building 10 is shown. Building 10 can be served by a building management system (BMS). A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof. An example of a BMS which can be used to monitor and control building 10 is described in U.S. patent application Ser. No. 14/717,593 filed May 20, 2015, the entire disclosure of which is incorporated by reference herein.

The BMS that serves building 10 may include a HVAC system 100. HVAC system 100 can include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 may provide a heated or chilled fluid to an air handling unit of airside system 130. Airside system 130 may use the heated or chilled fluid to heat or cool an airflow provided to building 10. In some embodiments, waterside system 120 can be replaced with or supplemented by a central plant or central energy facility (described in greater detail with reference to FIG. 2). An example of an airside system which can be used in HVAC system 100 is described in greater detail with reference to FIG. 2.

HVAC system 100 is shown to include a chiller 102, a boiler 104, and a rooftop air handling unit (AHU) 106. Waterside system 120 may use boiler 104 and chiller 102 to heat or cool a working fluid (e.g., water, glycol, etc.) and may circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 may add heat to the circulated fluid, for example, by burning a combustible material (e.g., natural gas) or using an electric heating element. Chiller 102 may place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 may place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 may transfer heat between the airflow and the working fluid to provide heating or cooling for the airflow. For example, AHU 106 can include one or more fans or blowers configured to pass the airflow over or through a heat exchanger containing the working fluid. The working fluid may then return to chiller 102 or boiler 104 via piping 110.

Airside system 130 may deliver the airflow supplied by AHU 106 (i.e., the supply airflow) to building 10 via air supply ducts 112 and may provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements.

AHU 106 can include various sensors (e.g., temperature sensors, pressure sensors, etc.) configured to measure attributes of the supply airflow. AHU 106 may receive input from sensors located within AHU 106 and/or within the building zone and may adjust the flow rate, temperature, or other attributes of the supply airflow through AHU 106 to achieve setpoint conditions for the building zone.

Airside System

Figure 2:
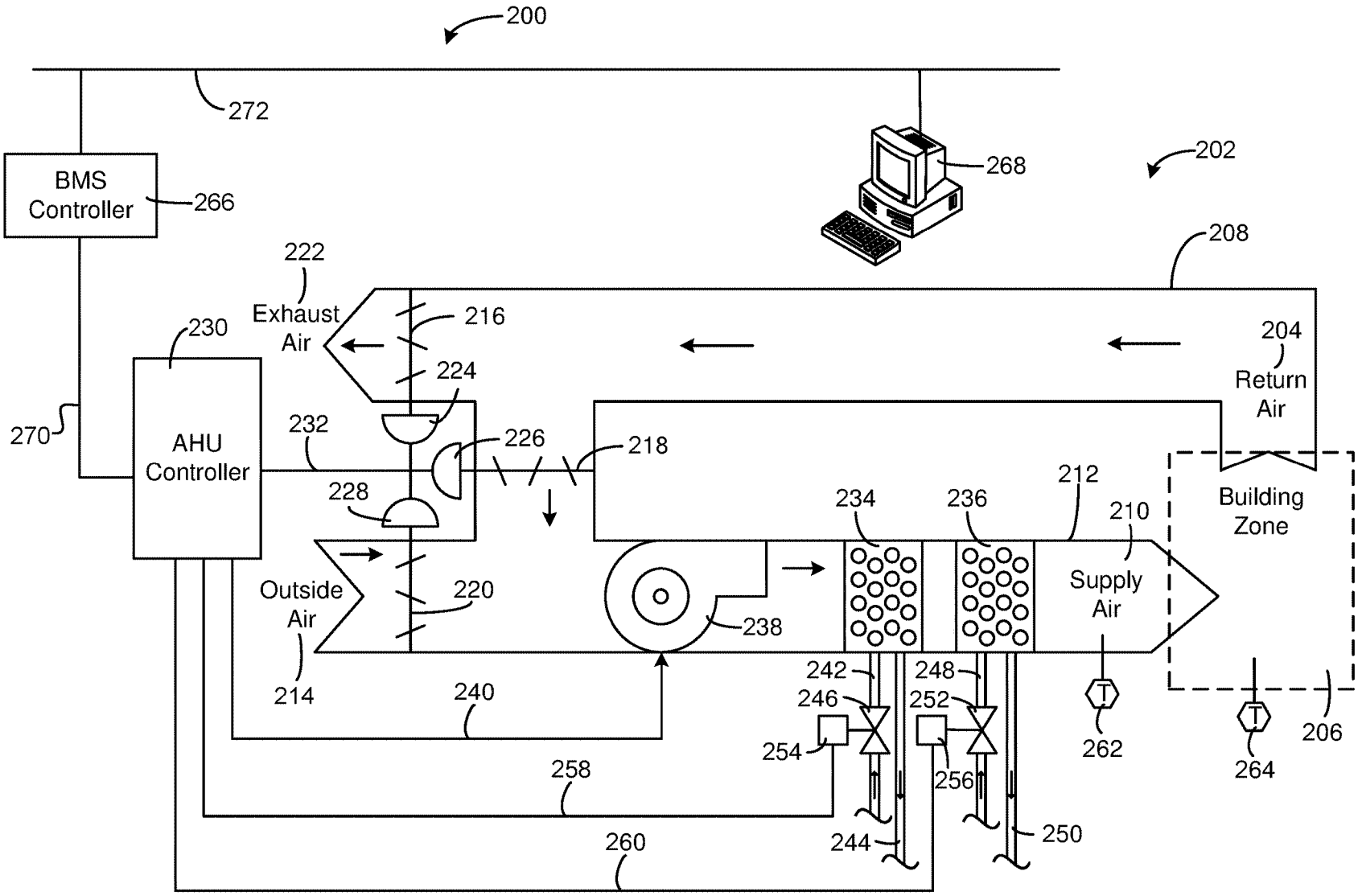
FIG. 2 is a block diagram of an airside system that can be implemented in the building of FIG. 1, according to some embodiments.

Referring now to FIG. 2, a block diagram of an airside system 200 is shown, according to some embodiments. In various embodiments, airside system 200 may supplement or replace airside system 130 in HVAC system 100 or can be implemented separate from HVAC system 100. When implemented in HVAC system 100, airside system 200 can include a subset of the HVAC devices in HVAC system 100 (e.g., AHU 106, VAV units 116, ducts 112-114, fans, dampers, etc.) and can be located in or around building 10. Airside system 200 may operate to heat, cool, humidify, dehumidify, filter, and/or disinfect an airflow provided to building 10 in some embodiments.

Airside system 200 is shown to include an economizer-type air handling unit (AHU) 202. Economizer-type AHUs vary the amount of outside air and return air used by the air handling unit for heating or cooling. For example, AHU 202 may receive return air 204 from building zone 206 via return air duct 208 and may deliver supply air 210 to building zone 206 via supply air duct 212. In some embodiments, AHU 202 is a rooftop unit located on the roof of building 10 (e.g., AHU 106 as shown in FIG. 1) or otherwise positioned to receive both return air 204 and outside air 214. AHU 202 can be configured to operate exhaust air damper 216, mixing damper 218, and outside air damper 220 to control an amount of outside air 214 and return air 204 that combine to form supply air 210. Any return air 204 that does not pass through mixing damper 218 can be exhausted from AHU 202 through exhaust damper 216 as exhaust air 222.

Each of dampers 216-220 can be operated by an actuator. For example, exhaust air damper 216 can be operated by actuator 224, mixing damper 218 can be operated by actuator 226, and outside air damper 220 can be operated by actuator 228. Actuators 224-228 may communicate with an AHU controller 230 via a communications link 232. Actuators 224-228 may receive control signals from AHU controller 230 and may provide feedback signals to AHU controller 230. Feedback signals can include, for example, an indication of a current actuator or damper position, an amount of torque or force exerted by the actuator, diagnostic information (e.g., results of diagnostic tests performed by actuators 224-228), status information, commissioning information, configuration settings, calibration data, and/or other types of information or data that can be collected, stored, or used by actuators 224-228. AHU controller 230 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 224-228.

Still referring to FIG. 2, AHU 202 is shown to include a cooling coil 234, a heating coil 236, and a fan 238 positioned within supply air duct 212. Fan 238 can be configured to force supply air 210 through cooling coil 234 and/or heating coil 236 and provide supply air 210 to building zone 206. AHU controller 230 may communicate with fan 238 via communications link 240 to control a flow rate of supply air 210. In some embodiments, AHU controller 230 controls an amount of heating or cooling applied to supply air 210 by modulating a speed of fan 238. In some embodiments, AHU 202 includes one or more air filters (e.g., filter 308) and/or one or more ultraviolet (UV) lights (e.g., UV lights 306) as described in greater detail with reference to FIG. 3. AHU controller 230 can be configured to control the UV lights and route the airflow through the air filters to disinfect the airflow as described in greater detail below.

Cooling coil 234 may receive a chilled fluid from central plant 200 via piping 242 and may return the chilled fluid to central plant 200 via piping 244. Valve 246 can be positioned along piping 242 or piping 244 to control a flow rate of the chilled fluid through cooling coil 234. In some embodiments, cooling coil 234 includes multiple stages of cooling coils that can be independently activated and deactivated (e.g., by AHU controller 230, by BMS controller 266, etc.) to modulate an amount of cooling applied to supply air 210.

Heating coil 236 may receive a heated fluid from central plant 200 via piping 248 and may return the heated fluid to central plant 200 via piping 250. Valve 252 can be positioned along piping 248 or piping 250 to control a flow rate of the heated fluid through heating coil 236. In some embodiments, heating coil 236 includes multiple stages of heating coils that can be independently activated and deactivated (e.g., by AHU controller 230, by BMS controller 266, etc.) to modulate an amount of heating applied to supply air 210.

Each of valves 246 and 252 can be controlled by an actuator. For example, valve 246 can be controlled by actuator 254 and valve 252 can be controlled by actuator 256. Actuators 254-256 may communicate with AHU controller 230 via communications links 258-260. Actuators 254-256 may receive control signals from AHU controller 230 and may provide feedback signals to controller 230. In some embodiments, AHU controller 230 receives a measurement of the supply air temperature from a temperature sensor 262 positioned in supply air duct 212 (e.g., downstream of cooling coil 334 and/or heating coil 236). AHU controller 230 may also receive a measurement of the temperature of building zone 206 from a temperature sensor 264 located in building zone 206.

In some embodiments, AHU controller 230 operates valves 246 and 252 via actuators 254-256 to modulate an amount of heating or cooling provided to supply air 210 (e.g., to achieve a setpoint temperature for supply air 210 or to maintain the temperature of supply air 210 within a setpoint temperature range). The positions of valves 246 and 252 affect the amount of heating or cooling provided to supply air 210 by cooling coil 234 or heating coil 236 and may correlate with the amount of energy consumed to achieve a desired supply air temperature. AHU controller 230 may control the temperature of supply air 210 and/or building zone 206 by activating or deactivating coils 234-236, adjusting a speed of fan 238, or a combination of both.

Still referring to FIG. 2, airside system 200 is shown to include a building management system (BMS) controller 266 and a client device 268. BMS controller 266 can include one or more computer systems (e.g., servers, supervisory controllers, subsystem controllers, etc.) that serve as system level controllers, application or data servers, head nodes, or master controllers for airside system 200, central plant 200, HVAC system 100, and/or other controllable systems that serve building 10. BMS controller 266 may communicate with multiple downstream building systems or subsystems (e.g., HVAC system 100, a security system, a lighting system, central plant 200, etc.) via a communications link 270 according to like or disparate protocols (e.g., LON, BACnet, etc.). In various embodiments, AHU controller 230 and BMS controller 266 can be separate (as shown in FIG. 2) or integrated. In an integrated implementation, AHU controller 230 can be a software module configured for execution by a processor of BMS controller 266.

In some embodiments, AHU controller 230 receives information from BMS controller 266 (e.g., commands, setpoints, operating boundaries, etc.) and provides information to BMS controller 266 (e.g., temperature measurements, valve or actuator positions, operating statuses, diagnostics, etc.). For example, AHU controller 230 may provide BMS controller 266 with temperature measurements from temperature sensors 262-264, equipment on/off states, equipment operating capacities, and/or any other information that can be used by BMS controller 266 to monitor or control a variable state or condition within building zone 206.

Client device 268 can include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, its subsystems, and/or devices. Client device 268 can be a computer workstation, a client terminal, a remote or local interface, or any other type of user interface device. Client device 268 can be a stationary terminal or a mobile device. For example, client device 268 can be a desktop computer, a computer server with a user interface, a laptop computer, a tablet, a smartphone, a PDA, or any other type of mobile or non-mobile device. Client device 268 may communicate with BMS controller 266 and/or AHU controller 230 via communications link 272.

Extraction and Collection Systems

Figure 3:
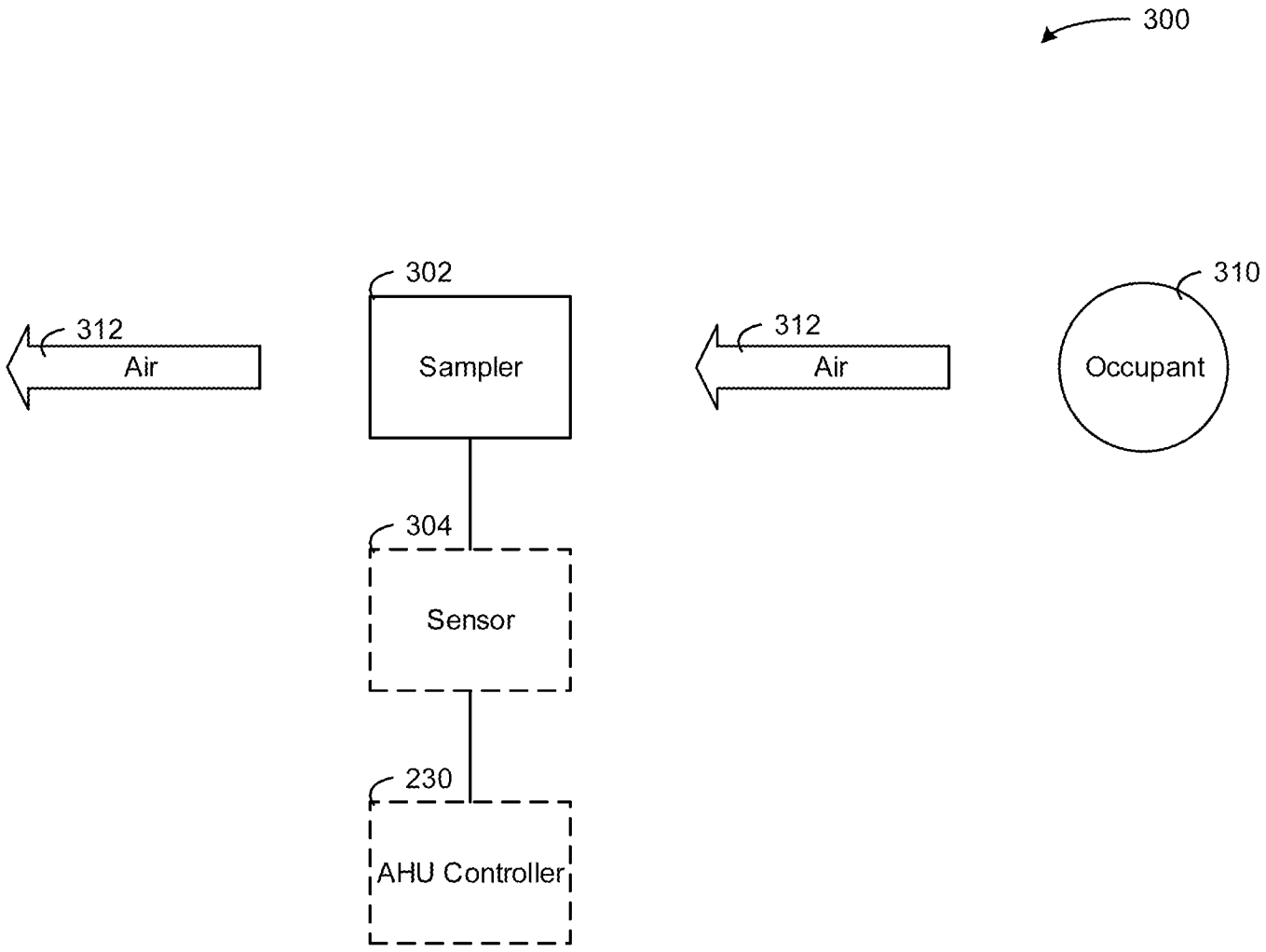
FIG. 3 is a block diagram of a collection system, according to some embodiments.

Referring now to FIG. 3, a collection system 300 is shown, according to some embodiments. The collection system 300 can be a system configured to extract and collect samples. The extraction and collection of samples can be directed to a sensor 304 for analysis, such as to test for pathogens (sometimes referred to herein as "infectious disease particles"). The analysis can be transmitted to the AHU controller 230 (and/or BMS controller 266) for HVAC system updates (e.g., change air flow, modify damper, increase temperature, decrease temperature, allow additional outside air 414, etc.). While various embodiments discuss extraction and collection of samples, it should be understood that the techniques described herein may also be applied to extracting and collecting other materials. All such modifications are contemplated within the scope of the present disclosure.

In the collection system 300, an occupant 310 (e.g., a person or animal) may exhale air 312. Furthermore, the occupant 310 could cough or sneeze. If the occupant 310 is infected with a pathogen or is a carrier of an pathogen, the exhaled air 312 can include particles of a pathogen (e.g., if the particles are airborne). Various other pathogens can be exhaled, sneezed, and/or coughed out by the occupant 310. In various other cases, the pathogens could come from mold growing in a building, a water leak including a pathogen particle, an aerosol dispersed in the building, a powder or other agent released in the building, a contaminant or other substance present in the building or a zone of the building, etc.

The air 312 can be passed through a sampler 302. The sampler 302 can be coupled to, part of, or included in a waterside system 120, an airside system 130, or another other HVAC system 100. The sampler 302 can be an HVAC device configured to draw the air 312 into a coil (e.g., dehumidifier, atmospheric water generating (AWG)), a chamber (e.g., humidifier), a member (e.g., member that passes water vapor), or a pressurizer (e.g., system for pressurizing the air, which traps a liquified sample from the air over a given period. The sampler 302 can direct or provide the liquified sample to a sensor 304. The HVAC system 100 (e.g., sampler 302) can be configured/structured to provide a sample to any kind of sensor 304 that receives the liquified sample and tests the sample for pathogens. While the present disclosure discusses examples where a sampler 302 extracts and collects liquified sample, it should be understood that the present disclosure applies to any type of sample. In some implementations, the sensor 304 and AHU controller 230 may be removed from the collection system 300.

Figure 4:
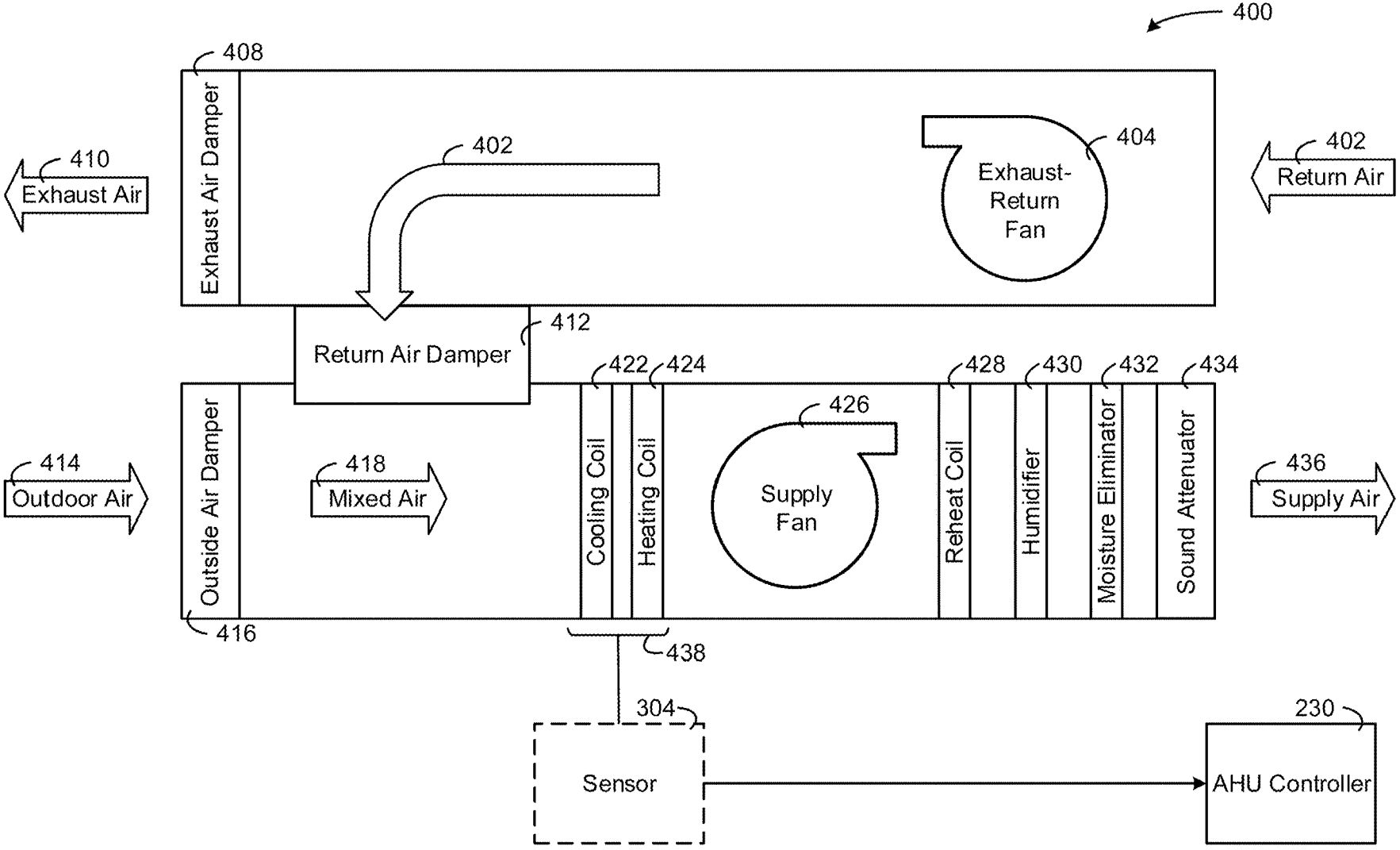
FIG. 4 is a block diagram of an air system of a building with a collection system that collects liquified samples from a cooling coil of the air system, according to an exemplary embodiment.

Referring now to FIG. 4, an air system 400 of a building with a collection system that collects liquified samples from a cooling coil 422 of the air system 400 is shown, according to an exemplary embodiment. In some cases, the particles of the air can be trapped directly in a fluid through a component, e.g., a component of a building air system. The air system 400 can be an air handler unit, a rooftop unit, a duct system of a building, etc.

The air system 400 can receive return air 402. The return air 402 can be air returned from one or more spaces of a building where occupants are located. Because the occupants may be carrying a pathogen that is released into the air through exhaling, coughing, sneezing, etc. The return air 402 can include particles of a pathogen. An exhaust-return fan 404 can suck the return air 402 in and dispel the return air 402 as exhaust air 410 through an exhaust air damper 408. The exhausted air 410 can be exhausted out of the building.

The return air 402 can be provided to a return air damper 412 which can be mixed with outdoor air 414 that enters the system 400 through an outside air damper 416. The mixed air 418, which can be a mix of the return air 402 and the outdoor air 414, can be passed through a cooling coil 422 and/or a heating coil 424. The cooling coil 422 and/or the heating coil 424 can be refrigerant and/or water based coils that cool or heat the mixed air 418. A supply fan 426 can provide the conditioned air through a reheat coil 428, a humidifier 430, a moisture eliminator 432, and a sound attenuator 434 before providing the air as supply air 436 back to spaces of the building, e.g., to VAV boxes serving various spaces of the building.

A collection apparatus 438 (also referred to herein as a "collection tray") can be configured to collect condensation from the cooling coil 422. The collection apparatus 438 can include one or more pipe systems, fittings, sponge systems, wash systems, suction systems, drip pans, mechanical wipe systems, etc. Condensation that forms on the cooling coil 422 can be collected by the collection apparatus 438 and provided to the sensor 304 for analysis and testing. As shown, the collection apparatus 438 can also collect liquid from the heating coil 424, upon the liquid vapor in the air condensing.

While the coiling/dehumidification water in the air condenses on the surface of the cooling coil, making the entire surface of the cooling coil wet. Over time this water flows down the surface (based on gravitational force) of the cooling coil and is collected by the collection apparatus 438, e.g., in a drain pan or drip pan or collection pan. In some cases, the particles of the sample are collected in the condensate water and are representative of the particles in the air. This condensate water could be fed directly to (or provided manually by a technician) the sensor 304 by the collection apparatus 438. In some embodiments, the particles can be collected from the cooling coil 422 while the system 400 is in a cooling mode. When the system 400 is in a heating mode, the particles can be collected from the humidifier 430 as described in FIG. 5.

In some embodiments, air system 400 may be configured to direct the sample to a sensor 304 that performs testing to identify pathogens. In some embodiments, a building management system (BMS) 440 may be configured to receive result(s) of the testing from the sensor 304, such as via a network connection between the sensor 304 and the BMS 440. In some embodiments, the results of testing may be received by the AHU controller 230 and/or a cloud system, e.g., the building data platform described in U.S. patent application Ser. No. 17/134,664, filed Dec. 28, 2020, the entirety of which is incorporated by reference herein.

The AHU controller 230 (and/or BMS controller 266) can be configured to operate systems of a building to reduce a spread of a pathogen in a building based on extraction and collection of samples by system 400 (e.g., using data communicated back from the sensor 304). The AHU controller 230 can be configured to perform building control for conditions of the building (e.g., air changes, air mix, temperature levels, humidity levels, etc.) that reduces the spread of an pathogens in the building. The control that the AHU controller 230 can perform, according to various illustrative implementations, is described in U.S. patent application Ser. No. 17/013,273, filed Sep. 4, 2020, U.S. patent application Ser. No. 16/927,318 filed Jul. 13, 2020, and U.S. patent application Ser. No. 17/393,138 filed Aug. 3, 2021, the entirety of each of which is incorporated by reference herein.

In some embodiments, the system 400 can run a test cycle. In some embodiments, a contaminant with a known pathogen can be introduced into the system 400 and/or introduced into the airstream of the system 400. The collection apparatus 438 can collect condensate from the cooling coil 422 (or via another method) and the sensor 304 can be provided the collected condensation for testing whether the pathogen is detectable. In some embodiments, the particle introduced into the system are highly unlikely to be present in the test location.

In some embodiments, the pathogen is introduced as an impulse function (short duration) and a significant period of time (e.g., 1 month) is waited before testing. After the time period passes, the sensor 304 can test for the pathogen. If the pathogen is no longer detectable in the condensate (e.g., liquified sample), it can be concluded that the test results reflect the current pathogen state of the air stream.

In some embodiments, the collection apparatus 438 could be installed to collect moisture from a thermo-electric cooler of the system 400. The collection apparatus 438 could cause moisture in the air to condense onto a plate. Dirt in the air would be trapped in the water and the water would be collected for analysis. In some embodiments, the collection apparatus 438 can wipe the plate to ensure a clean start on each cycle.

Figure 5:
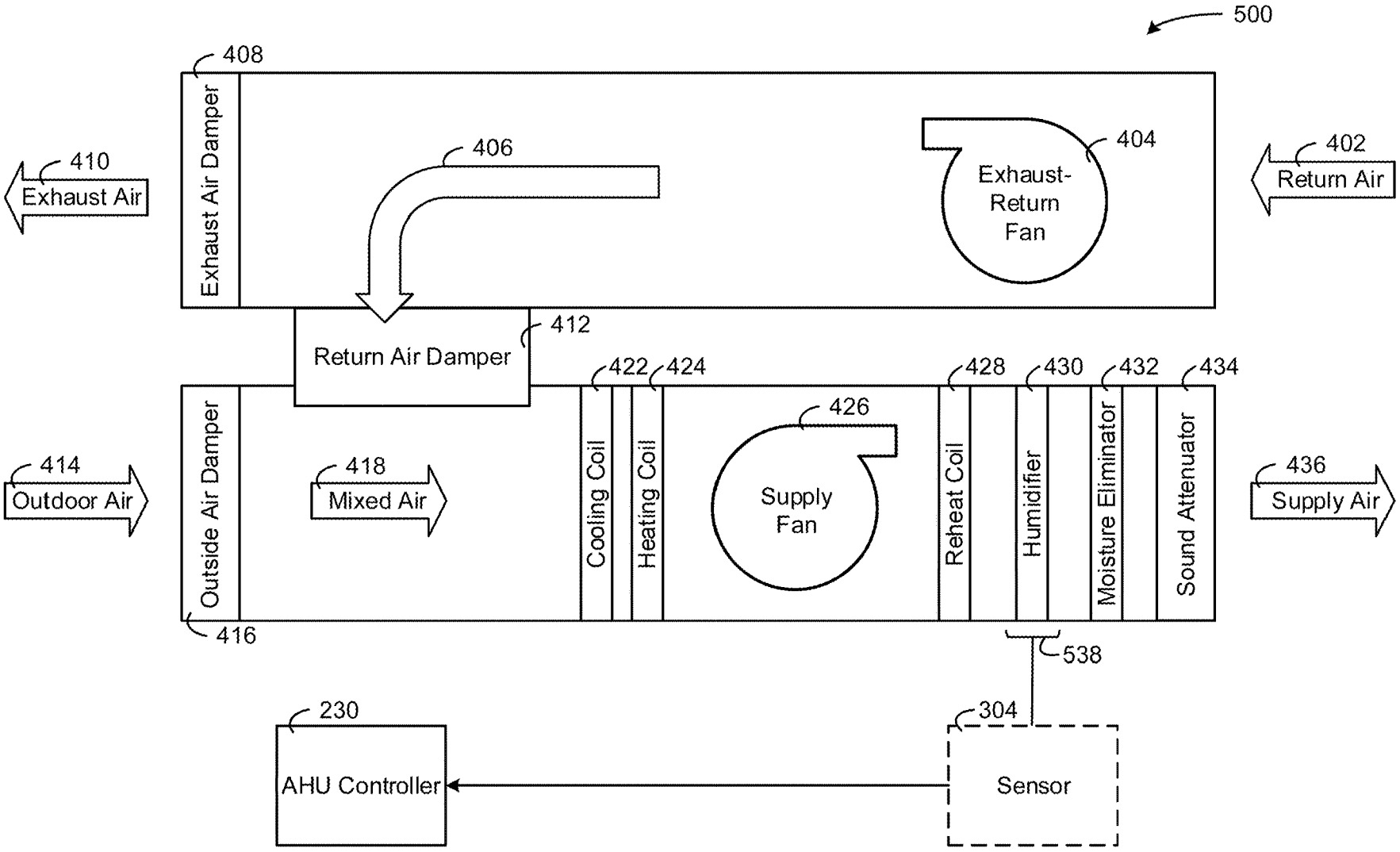
FIG. 5 is a block diagram of an air system of the building that collects liquified samples from a humidifier of the air system, according to an exemplary embodiment.

Referring now to FIG. 5, the air system 500 of a building that collects liquified samples from the humidifier 430 of the air system 500 is shown, according to an exemplary embodiment. The collection apparatus 538 can be configured to collect water from the humidifier 430. The collection apparatus 538 can be similar to, or the same as, the collection apparatus 438. The humidifier 430 can include a sponge or sponge like packing material in which tap water flows over. HVAC system air flows over the packing evaporating the water and thus humidifying the air. Because all of the water does not evaporate, the collection apparatus 538 can collect the excess water, e.g., a drain pan can collect the excess water of the humidifier 430. The liquified sample collected can be provided to a sensor 304 for testing.

The reheat coil 428 can include a plurality of coils configured to increase or decrease the temperature and pressure of the air before passing it to the humidifier 430 of the air system. For example, in response to the humidifier 430 in a heating mode operation, the reheat coil 428 can increase the temperature (i.e., heats) and/or pressure (i.e., pressurizes) of the air from the supply fan 426 prior to providing the air to the humidifier 430. In the following example, the reheat coil 428 can reduce energy load on the humidifier 430 and allow the humidifier to operate more efficiently in humidifying the air.

Figure 6:
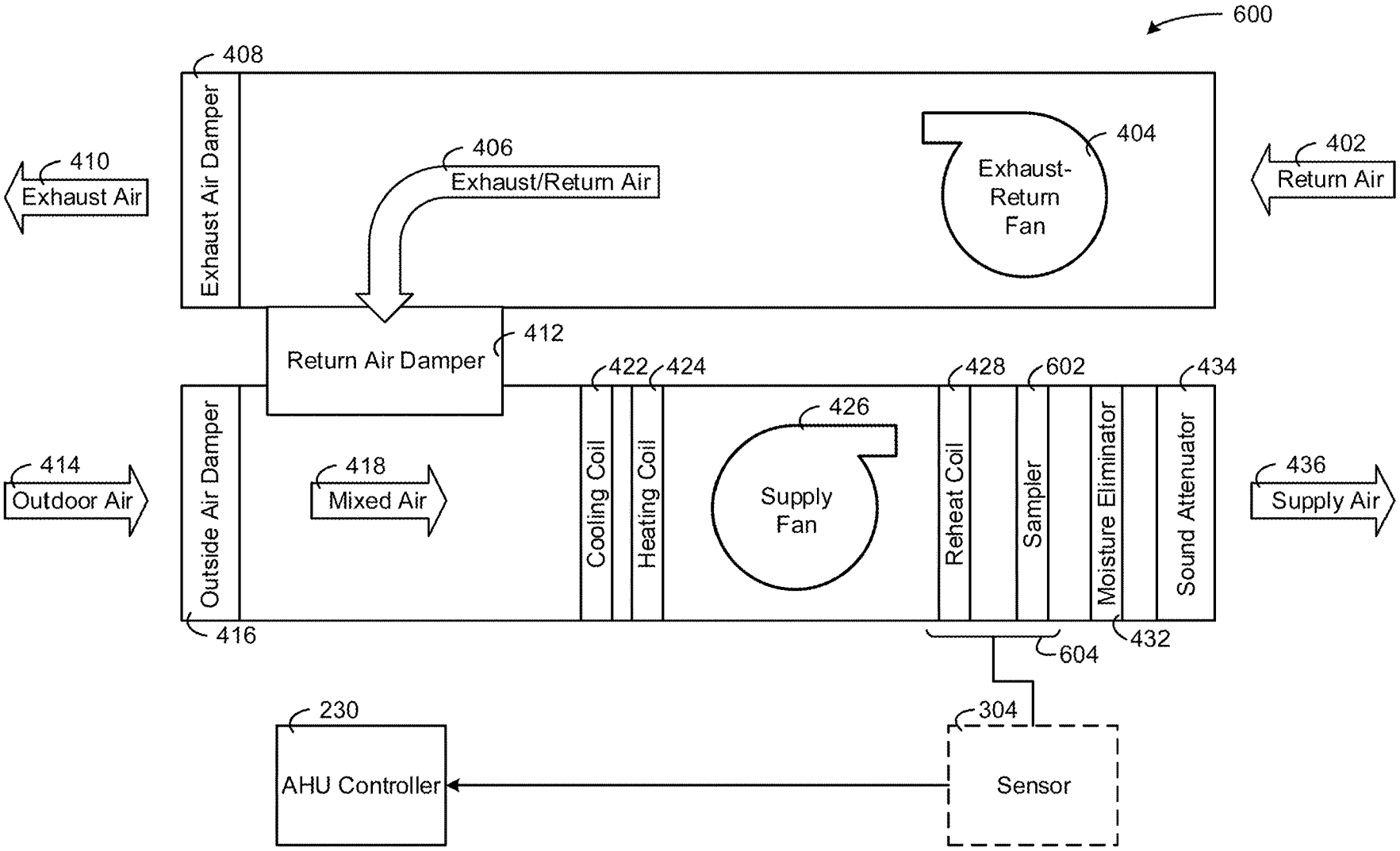
FIG. 6 is a block diagram of another air system of the building that collects liquified samples from a reheat coil, according to an exemplary embodiment.

Referring now to FIG. 6, an air system 600 of a building that collects liquified samples from a reheat coil 428, according to an exemplary embodiment. The air system 600 can be similar to or the same as the air system 400. The air system 600 can also include a sampler 602. The sampler 602 includes similar features and functionality as described in detail with reference to sampler 302 of FIG. 3. An apparatus 604 can collect liquid from the sampler 602 and provide it to a sensor 304 for testing. The sampler 602 could include a filter with material on the surface, e.g., fabric which draws moisture from the air. In some embodiments, the material could be similar to an air filter.

The reheat coil 428 can include a plurality of coils configured to increase or decrease the temperature and pressure of the air before passing it to the sampler 602 of the air system. For example, in response to the sampler 602 in a sampling mode operation, the reheat coil 428 can increase or decrease the temperature (i.e., heats or cools) and/or pressure (i.e., pressurizes) of the air from the supply fan 426 prior to providing the air to the sampler 602. In the following example, the reheat coil 428 can increase the efficiency of the sampler 602 by enabling the filter to collect liquid from the air. As shown, the apparatus 604 can also collect liquid from the reheat coil 428, upon the liquid vapor in the air condensing.

Figure 7:
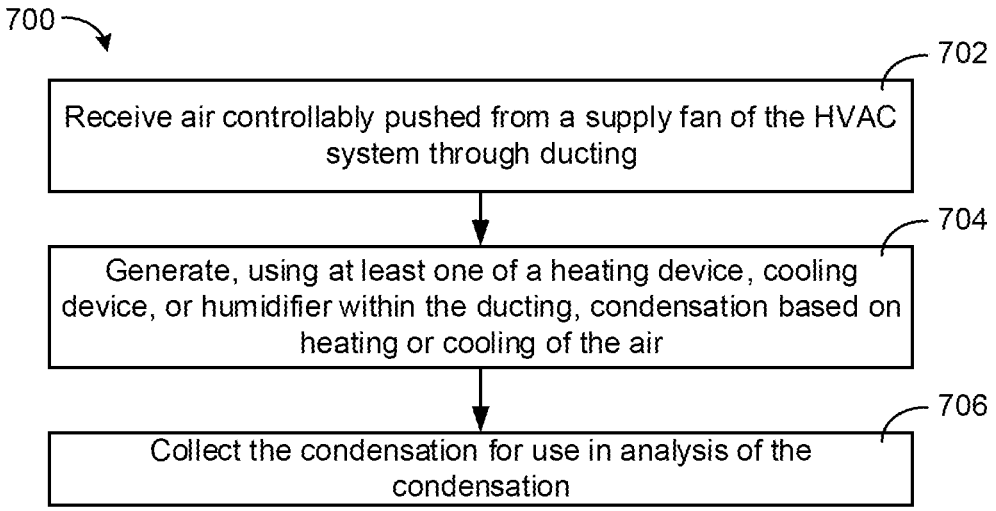
FIG. 7 is a flow diagram of a process of collecting condensation, according to an exemplary embodiment.

Referring now to FIG. 7 is a flow diagram of a process 700 of collecting condensation, according to an exemplary embodiment. The process 700 can be performed by the various systems described with reference to FIGS. 1-6. For example, the system 400, the system 500, and/or the system 600 can be configured to perform the process 700. While FIG. 7 is described with reference to the system 400 of FIG. 4, the process 700 can be performed by any of the systems 400, 500, and/or 600.

In step 702, the air system 400 (or the air system 500 or 600) can receive air controllably pushed from a supply fan of the HVAC system through ducting. The air can be return air or outside air and the air can contain one or more infectious disease particles or pathogens exhaled by occupants of a building. The return air can be air returned from one or more zones or other areas of a building that are collected by the air system 400. Because occupants can exhale the disease particles, cough, and release the disease particles, sneeze and release the particles, etc. the return air 402 can include the disease particles. The air system 400 can be a rooftop air handling unit configured to be positioned on a roof of the building.

In step 704, the one or more components of the air system 400 can generate condensation based on heating or cooling of the air. Heating or cooling can be performed using a heating device, cooling device, or humidifier within the ducting. In various embodiments, the heating device includes a heating coil configured to heat the air moved through the ducting by the supply fan. An air handling unit controller of the air system 400 can selectively control operation of the heating coil to generate the condensation. In some embodiments, the cooling device includes a cooling coil configured to cool the air moved through the ducting by the supply fan. An air handling unit controller of the air system 400 can selectively control operation of the cooling coil to generate the condensation.

In some embodiments, at step 704, the one or more components of the air system 400 can include a return air damper coupled to the ducting and configured to intake return air, an outside air damper coupled to the ducting and configured to intake outside air, and an exhaust air damper coupled to the ducting and configured to dispel the return air. The air handling unit controller can selectively control an airflow source of the air flowing through the air handling unit, and wherein the airflow source includes at least one of the return air or the outside air. In particular, selectively controlling the airflow source includes controlling at least one of the return air damper or the outside air damper. For example, the condensation can be collected and used for analysis when the airflow source is the return air and the outside air damper is closed. Additionally, the air handling unit controller can selectively control the dispel of the return air, via the exhaust air damper, for a period of time based on collecting the condensation including the infectious disease particles.

In step 706, the one or more components of the air system 400 can collect the condensation (via gravity) for use in analysis of the condensation, wherein the condensation includes infectious disease particles form the air flowing through the air handling unit. In some embodiments, a collection apparatus 438 can collect the condensation from the cooling coil 422 which includes the one or more disease particles. In some embodiments, excess liquid of the humidifier 430 can be collected via the collection apparatus 538 that includes the one or more disease particles. That is, the air system 400 can activate the humidifier when the air handling unit is in a heating mode of operation. In some embodiments, a liquid including the one or more infectious disease particles can be collected via the sampler 602 and collected via the collection apparatus 604. The collected liquid can be provided to sensor 304 for testing of pathogens. In some embodiments, the AHU controller 230 can receive results of the testing from the sensor 304 and take one or more actions responsive to the results. In some embodiments, AHU controller 230 can perform various operations via various systems of the building.

Configuration of Exemplary Embodiments

Although the FIGS. show a specific order of method steps, the order of the steps may differ from what is depicted. Also, two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, calculation steps, processing steps, comparison steps, and decision steps.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

As used herein, the term "circuit" may include hardware structured to execute the functions described herein. In some embodiments, each respective "circuit" may include machine-readable media for configuring the hardware to execute the functions described herein. The circuit may be embodied as one or more circuitry components including, but not limited to, processing circuitry, network interfaces, peripheral devices, input devices, output devices, sensors, etc. In some embodiments, a circuit may take the form of one or more analog circuits, electronic circuits (e.g., integrated circuits (IC), discrete circuits, system on a chip (SOCs) circuits, etc.), telecommunication circuits, hybrid circuits, and any other type of "circuit." In this regard, the "circuit" may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on).

The "circuit" may also include one or more processors communicably coupled to one or more memory or memory devices. In this regard, the one or more processors may execute instructions stored in the memory or may execute instructions otherwise accessible to the one or more processors. In some embodiments, the one or more processors may be embodied in various ways. The one or more processors may be constructed in a manner sufficient to perform at least the operations described herein. In some embodiments, the one or more processors may be shared by multiple circuits (e.g., circuit A and circuit B may comprise or otherwise share the same processor which, in some example embodiments, may execute instructions stored, or otherwise accessed, via different areas of memory). Alternatively, or additionally, the one or more processors may be structured to perform or otherwise execute certain operations independent of one or more co-processors. In other example embodiments, two or more processors may be coupled via a bus to enable independent, parallel, pipelined, or multithreaded instruction execution. Each processor may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more processors may take the form of a single core processor, multi-core processor (e.g., a dual core processor, triple core processor, quad core processor, etc.), microprocessor, etc. In some embodiments, the one or more processors may be external to the apparatus, for example the one or more processors may be a remote processor (e.g., a cloud based processor). Alternatively, or additionally, the one or more processors may be internal and/or local to the apparatus. In this regard, a given circuit or components thereof may be disposed locally (e.g., as part of a local server, a local computing system, etc.) or remotely (e.g., as part of a remote server such as a cloud based server). To that end, a "circuit" as described herein may include components that are distributed across one or more locations.

The present disclosure contemplates methods, systems, and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

What is claimed is:

1. An air handling unit of an HVAC system of a building comprising:

ducting through which airflow is controllably pushed by a supply fan of the HVAC system;

an air damper coupled to the ducting and configured to at least one of intake return air, intake outside air, or dispel return air;

at least one of a heating or cooling device within the ducting;

an air handling unit controller configured to control operation of the at least one of the heating or cooling device within the ducting to generate condensation from air flowing through the air handling unit; and a collector tray placed within and/or integrated with the ducting below the at least one of the heating or cooling device and structured to collect the condensation, via gravity, for use in analysis of the condensation;

wherein the at least one of the heating or cooling device, the air handling unit controller, and the collector tray are configured to collect the condensation including infectious disease particles from the air flowing through the air handling unit; and wherein the air handling unit controller is further configured to selectively control the air damper for a period of time based on collecting the condensation including the infectious disease particles.

2. The air handling unit of claim 1, the at least one of the heating or cooling device comprising a cooling coil and a heating coil configured to cool and heat, respectively, the air moved through the ducting by the supply fan, the air handling unit controller configured to selectively control operation of the cooling coil and the heating coil to generate the condensation.

3. The air handling unit of claim 1, wherein the condensation is collected when the cooling device is in a cooling mode or when the heating device is in a heating mode.

4. The air handling unit of claim 1, further comprising:

a return air damper coupled to the ducting and configured to intake the return air;

an outside air damper coupled to the ducting and configured to intake the outside air; and an exhaust air damper coupled to the ducting and configured to dispel the return air.

5. The air handling unit of claim 4, wherein the air handling unit controller is further configured to selectively control an airflow source of the air flowing through the air handling unit, and wherein the airflow source comprises at least one of the return air or the outside air.

6. The air handling unit of claim 5, wherein selectively controlling the airflow source comprises controlling at least one of the return air damper or the outside air damper, and wherein the condensation is collected and used for analysis when the airflow source is the return air and the outside air damper is closed.

7. The air handling unit of claim 4, wherein the air handling unit controller is further configured to selectively control the exhaust air damper to dispel the return air for the period of time based on collecting the condensation including the infectious disease particles.

8. The air handling unit of claim 1, wherein the air handling unit is a rooftop air handling unit configured to be positioned on a roof of the building.

9. An air handling unit of an HVAC system comprising:

ducting through which airflow is controllably pushed by a supply fan of the HVAC system;

an air damper coupled to the ducting and configured to at least one of intake return air, intake outside air, or dispel return air;

a humidifier within the ducting and configured to evaporate water into air flowing through the ducting, wherein a portion of the water is not evaporated into the air;

an air handling unit controller configured to activate the humidifier; and a collector tray placed within and/or integrated with the ducting below the humidifier and structured to collect the portion of the water from the humidifier not evaporated into the air, via gravity, for use in analysis of the water, wherein the collector tray is configured to collect condensation including infectious disease particles from the air flowing through the air handling unit;

wherein the air handling unit controller is further configured to selectively control the air damper for a period of time based on collecting the condensation including the infectious disease particles.

10. The air handling unit of claim 9, further comprising the air handling unit controller configured to activate the humidifier when the air handling unit is in a heating mode of operation.

11. The air handling unit of claim 10, further comprising:

a return air damper coupled to the ducting and configured to intake the return air;

an outside air damper coupled to the ducting and configured to intake the outside air; and an exhaust air damper coupled to the ducting and configured to dispel the return air.

12. The air handling unit of claim 11, wherein the air handling unit controller is further configured to selectively control an airflow source of the air flowing through the air handling unit, and wherein the airflow source comprises at least one of the return air or the outside air.

13. The air handling unit of claim 12, wherein selectively controlling the airflow source comprises controlling at least one of the return air damper or the outside air damper, and wherein the condensation is collected and used for analysis when the airflow source is the return air and the outside air damper is closed.

14. The air handling unit of claim 11, wherein the air handling unit controller is further configured to selectively control the exhaust air damper to dispel the return air for the period of time based on collecting the condensation including the infectious disease particles.

15. The air handling unit of claim 9, wherein the air handling unit is a rooftop air handling unit configured to be positioned on a roof of a building.

16. The air handling unit of claim 9, further comprising:

a reheat coil within the ducting, wherein the reheat coil heats or pressurizes the air in the ducting prior to the humidifier evaporating the water.

17. A method of collecting condensations, the method comprising:

receiving, by an air handling unit of an HVAC system, air controllably pushed from a supply fan of the HVAC system through ducting;

generating, by the air handling unit using at least one of a heating device, cooling device, or humidifier within the ducting, condensation based on heating or cooling of the air; and collecting, by the air handling unit via gravity, the condensation for use in analysis of the condensation, wherein the condensation comprises infectious disease particles from the air flowing through the air handling unit;

selectively controlling, by the air handling unit, an air damper for a period of time based on collecting the condensation including the infectious disease particles, wherein the air damper corresponding to at least one of intaking return air, intaking outside air, or dispelling return air.

18. The method of claim 17, wherein the at least one of a heating or cooling device comprise a cooling coil and a heating coil configured to cool and heat, respectively, the air moved through the ducting by the supply fan, and wherein the method further comprises:

selectively controlling, by the air handling unit, operation of the cooling coil and the heating coil to generate the condensation.

19. The method of claim 17, further comprises:

activating, by the air handling unit, the humidifier when the air handling unit is in a heating mode of operation.

20. The method of claim 17, further comprising:

selectively controlling, by the air handling unit, an airflow source of the air flowing through the air handling unit, and wherein the airflow source comprises at least one of the return air or the outside air, and wherein selectively controlling the airflow source comprises controlling at least one of a return air damper or an outside air damper, and wherein the condensation is collected when the airflow source is the return air and the outside air damper is closed.

* * * * *